United States Patent [19]

Boeder

[11] Patent Number: 4,524,694

[45] Date of Patent: Jun. 25, 1985

[54] CLUSTER BOMB PROJECTILE

[75] Inventor: Dieter Boeder, Duesseldorf, Fed. Rep. of Germany

[73] Assignee: Rheinmetall GmbH, Duesseldorf, Fed. Rep. of Germany

[21] Appl. No.: 436,076

[22] Filed: Oct. 22, 1982

[30] Foreign Application Priority Data

Oct. 24, 1981 [DE] Fed. Rep. of Germany ..... 3142313

[51] Int. Cl.[3] ..... F42B 13/50; F42B 25/16

[52] U.S. Cl. ..... 102/393; 102/489

[58] Field of Search ..... 102/340, 342, 351, 357, 102/377, 378, 382, 393, 394, 489, 505; 220/281, 261, 293, 298, 243

[56] References Cited

U.S. PATENT DOCUMENTS

| | | | |
|---|---|---|---|
| 2,450,910 | 10/1948 | O'Rear | 102/393 |
| 2,604,043 | 7/1952 | Frisch et al. | 102/393 |
| 2,809,583 | 10/1957 | Ortynsky | 102/393 |
| 3,016,011 | 1/1962 | Brown | 102/393 |
| 3,461,801 | 9/1969 | Vitale et al. | 102/393 |
| 4,178,851 | 12/1977 | Brady | 102/394 |

FOREIGN PATENT DOCUMENTS

| | | | |
|---|---|---|---|
| 67141 | 3/1940 | Czechoslovakia | 102/394 |
| 1815822 | 10/1969 | Fed. Rep. of Germany | 102/394 |
| 2558060 | 6/1977 | Fed. Rep. of Germany . | |
| 2903938 | 8/1980 | Fed. Rep. of Germany | 102/393 |
| 2920347 | 11/1980 | Fed. Rep. of Germany | 102/489 |
| 0317037 | 1/1935 | Italy | 102/505 |
| 1500275 | 11/1969 | United Kingdom | 102/489 |
| 1605122 | 12/1981 | United Kingdom | 102/489 |

*Primary Examiner*—Charles T. Jordan

[57] ABSTRACT

A flying vehicle or projectile for transporting a plurality of useful loads which are to be expelled at a predetermined point of the flight path. The flying projectile or transport vehicle includes a useful load chamber that is defined by a cylindrically-shaped housing and includes means for expelling the useful load. The cylindrically shaped housing is formed by means of a plurality of mutually joined segments 13, 13' which are detachable from each other and which form a cylindrical housing surface. The individual segments have hook-shaped extensions 15, 15' through which a rod lockingly extends. Upon the predetermined ignition of a pyrotechnic charge a force is formed by the charge which causes each rod to move so as to unlock the mutually joined segments which thereupon detach themselves from each other to permit the expulsion of the useful loads.

10 Claims, 8 Drawing Figures

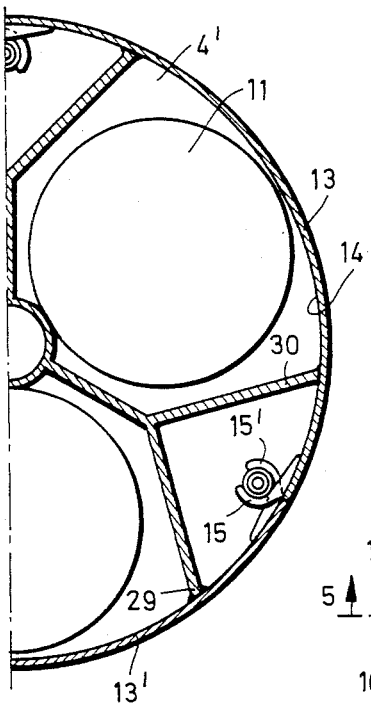
FIG. 3
FIG. 4
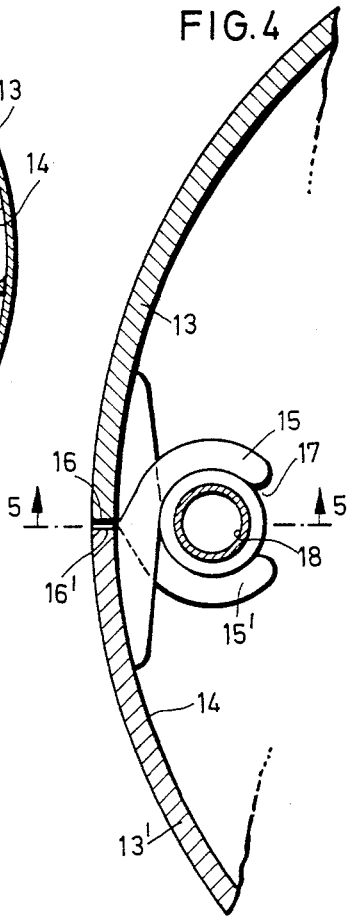

CLUSTER BOMB PROJECTILE

BACKGROUND OF THE INVENTION

The invention relates to a flying vehicle or projectile for transporting a plurality of useful loads to a predetermined point in a flight path, which flying vehicle has a useful load chamber enclosed in a cylindrical housing and means for expelling the useful load from the housing.

A flying vehicle or projectile, in which the useful load is expelled in the axial direction of the flying body, in particular in the flight direction, is already known and described in German published patent application No. 25 58 060. It is furthermore known to expell the useful loads rearwardly in the axial direction of the flying body.

With these known expelling methods it is generally not possible to distribute the useful load over a desired broad strip of terrain along the flight path of the flying vehicle or projectile.

SUMMARY OF THE INVENTION

It is an object of this invention to provide a flying projectile or vehicle by means of which the distribution of useful loads over relatively broad strip of terrain along the flight path of the flying vehicle or projectile is possible and which distinguishes itself by means of a particularly robust and acceleration-forces-resistant mechanical construction.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 3 is a plan view along a surface transverse to the longitudinal axis of the projectile or vehicle which view is along the plane defined by line 3—3 of FIG. 2;

FIG. 4 is an enlarged detailed illustration of the drawing of FIG. 3;

DETAILED DESCRIPTION OF A PREFERRED EMBODIMENT

Figure 1:
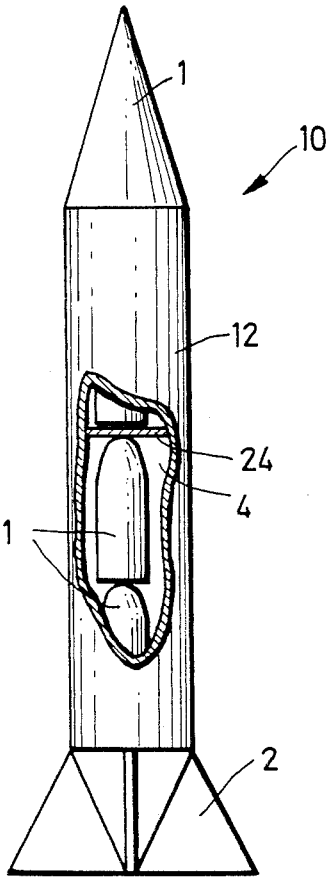
FIG. 1 is a schematic representation in side elevation of a flying projectile or vehicle, partially in section, having a cylindrically shaped housing, partially cut away, so that the useful load can be viewed.

FIG. 1 illustrates schematically a flying vehicle or projectile for transporting a plurality of useful loads which are to be expelled at a predetermined point of a flight path. There is disposed between the ogive 1 and the tail of the flying projectile a guiding arrangement 2, which flying projectile 10 is in the form of a hollow cylindrical shape defined by a cylindrical housing 12. This housing 12 encloses a useful load chamber 4, in which for example there are disposed transversely to the longitudinal axis of the flying projectile 10 a plurality of bottoms 24 which separate a plurality of useful loads 11 in the useful load chamber 4. In order to distribute the useful load over as broad as possible a strip of terrain along the flight path of the flying projectile by means of expelling useful loads 11 from the projectile 10, these useful loads 11 must be expelled in the radial direction, that is normal to the travel direction of the flying projectile 10. For that purpose it is required that at a predetermined point in time, that is at the time when the flying projectile 10 has reached a certain point along its flight path, the cylindrically shaped housing 12 which encloses the useful load chamber 4 is removed in order to permit the expulsion of the useful load in a radial direction.

The invention pertains in particular to the construction of the cylindrically-shaped housing 12 for the flying projectile 10 so that this housing at the start and during the traveling of the flying projectile 10 can withstand substantial acceleration forces in the longitudinal axial direction of the flying projectile 10 as well as also in the peripheral direction. The housing 12 must also be capable of being easily thrown off in order to permit the unhindered expulsion of the useful loads. Furthermore, its own proper weight must be as small as possible in order to substantially reduce the dead weight portion of the flying projectile.

The invention furnishes in particular the following advantages:

the entire exterior housing of the flying body section, from which the useful load 11 is to transversely expelled, can be simultaneously catapulted outwardly only on the basis of its own built-in prestressed condition;

the entire exterior housing takes over a substantial portion of the longitudinal mass-moment of inertia forces of the useful load which forces occur during flying and eventually during braking of the flying projectile in the flight path;

the entire housing takes over a substantial portion of the torsional moment-forces of the useful load which occur during rotation acceleration during flying and in the flight path which forces also are imparted to the fastening members of the projectile;

the various parts forming the housing require no riveting, welding or threadable connections but are only locked to each other by way of eccentrics and in interlocking projections and grooves, respectively toothing (bayonet-type) connections;

the housing can be joined with many randomly disposed intermediate bottoms for securing useful load groups which are substantially normal to the longitudinal axis of the flying body.

Figure 2:
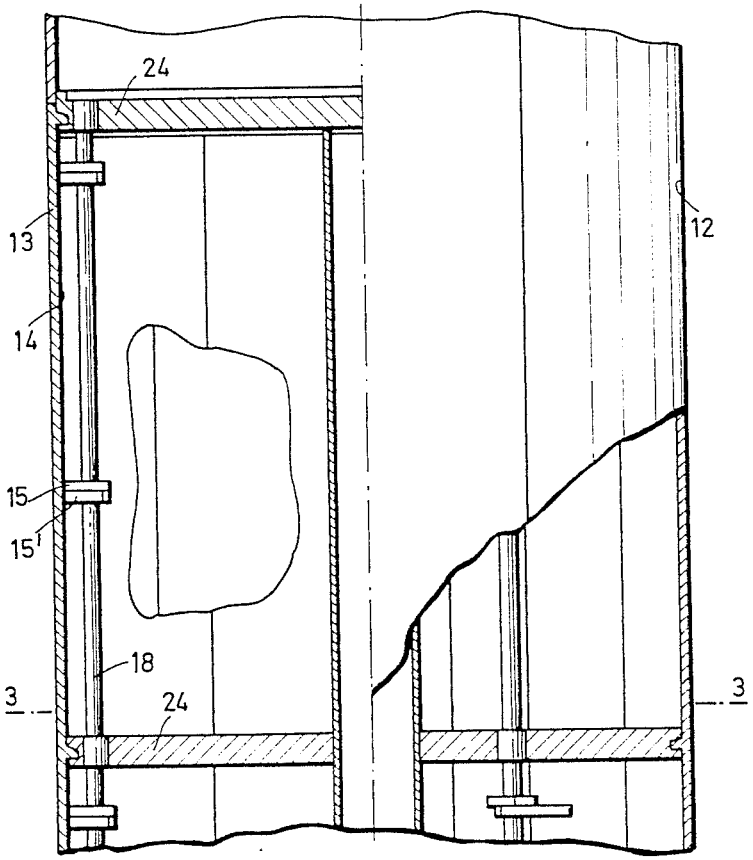
FIG. 2 is an elevational view which is partially in cross-section of the flying projectile or vehicle in the region of the useful load chamber.

The cylindrical shaped housing 12 consists of a plurality of mutually detachable joined segments 13, 13', which abut with their side edges 16, 16' against each other, so that they form a substantially cylindrical housing surface. The segments 13, 13' consists advantageously of an elastic material, so that when bent into a cylindrical housing surface there is built in a restoring force or resiliency in the segments 13, 13'. The segments 13, 13' can therefore, only by prestressing be forced into a cylindrical shape and be bracingly held in this position. This has the advantageous result that, after release of the bracing forces shortly prior to expulsion of the useful loads 11, the segments 13, 13' spring back into their original shape and in this manner separate themselves substantially automatically from the flying projectile and form exit openings for the expulsion of the useful loads 11. In order to achieve a prestressing of the segments 13, 13', which form the housing 12 of the flying projectile 10, there are arranged along each side edge 16, 16' of each segment 13, 13' adjoining the inner surface 14, hook-shaped extensions 15, 15' projecting inwardly with respect to the flying projectile 10. They surmount the respective side edges 16, 16' of the corresponding segments 13, 13' in the direction of the adjoining segments 13, respectively 13', and are offset with respect to the side edges 16, 16' of the abutting segments 13, 13' in such a way with respect to their elevation that they form pincer-like mutual overlapping pairs which encompass recesses 17. Thereby the recesses 17 which are formed by means of the extensions 15, 15' of adjoining segments 13, 13' are mutually aligned with each other along the edges 16, 16'. A rod 18 extends through these recesses 17, as can be particularly seen on FIGS. 2 and 5. Each rod 18 is parallel to the longitudinal axis of the flying projectile 10. For each joint abutment formed by adjoining segments 13, 13' there is provided such a rod 18.

Figure 5:
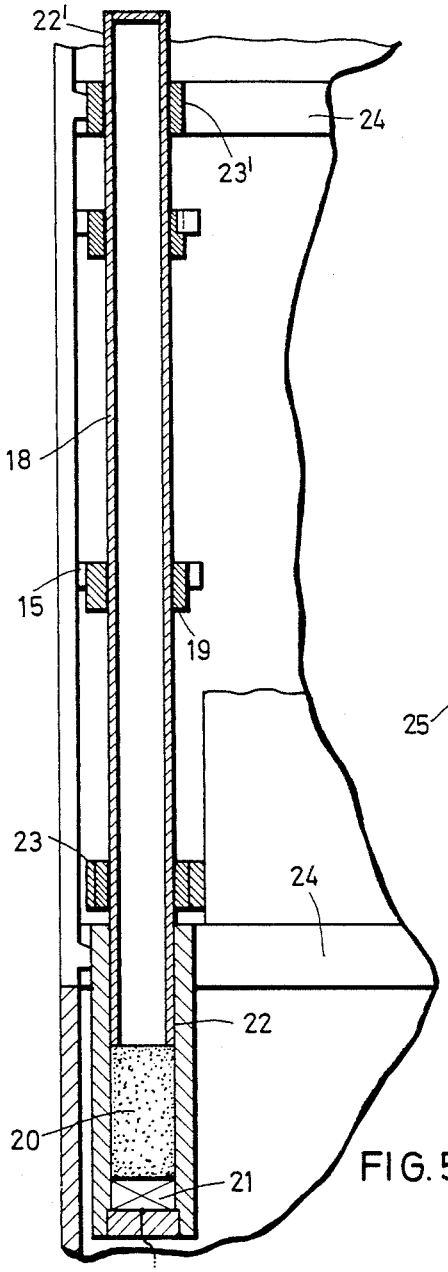
FIG. 5 is a cross-sectional view in the longitudinal axial direction of the flying projectile or vehicle along line 5—5 of FIG. 4.

FIG. 5 illustrates a partial sectional view in the longitudinal axial direction of the flying projectile 10 in the region of the mounting such a rod 18. The rod 18 has a plurality of abutments 19 eccentrically and/or conically shaped or having a wedge shape in the region of the hook-shaped extensions 15, 15', which extensions bear against the abutments 19, whereby when a relative rotation of the rod 18 relative to the hook-shaped extensions 15, 15' occurs, a mutual tensioning results.

Figure 6:
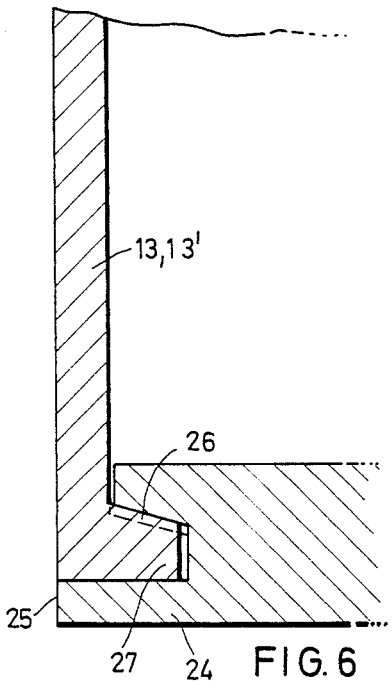
FIG. 6 is an enlarged cross-sectional view of the mounting of the segments on a bottom portion of the flying projectile or vehicle transverse to the longitudinal axis.

When conically-shaped and/or stepped-shaped abutments 19 are used for tensioning, the prestressing is achieved by longitudinal movement parallel to the longitudinal axis of the projectile 10 of the rod 18 during the mounting of the segments 13, 13'. After the predetermined expulsion point for the useful loads 11 has been reached by the flying projectile, the locking of the segements 13, 13' to each other, which had been achieved with the aid of the rod 18, can be removed in a simple manner by that the rod 18 is moved and/or turned in the opposite direction as had been carried out during the mounting of the rod 18. This longitudinal, respectively rotational movement of the rod 18 requires of course the application of a certain force. This force can be furnished in a particularly simple and malfunction-free manner by means of an electrically activatable igniter 21 provided with a pyrotechnic charge 20. The gases which are produced by the ignition of the pyrotechnic charge 20 can, as a result thereof, penetrate through the open end piece 22 of the rod 18 into the interior space and exert a force on the end surface which is disposed opposite to the open end piece. Since the pyrotechnic charge 20 simultaneously also acts on the annular surface of the rod 18, with which the latter abuts against the pyrotechnic charge 20, there results in a particularly advantageous fashion a pressure-pull-force on the rod 18 which causes it to move in a longitudinal axial direction with respect to the flying body resulting in an unlocking of the segments 13, 13'. The locking is thereby removed since the seats or abutments 19 of the rod 18 glide off the region of the hook-shaped extensions 15, 15' by means of the motion caused by the explosion of the pyrotechnic charge 20. In order to achieve a secure guiding of the rod 18, there are provided advantageously additional guides 23, 23' which for example are arranged on the intermediate bottoms 24 which divide the useful load chamber 4. In case the locking of the hook-shaped extensions 15, 15' is to be effected by means of eccentric seats or abutments 19, there must be brought about during the unlocking a rotational movement of the rod 18. As can be noted in particular from FIG. 2, FIG. 5, FIG. 6, FIG. 7, there are provided for the formation and/or compartmentilization of the useful load chamber 4 the intermediate bottoms 24 which extend transversely to the longitudinal axis of the flying projectile 10; the segments 13, 13' abut with their interior surfaces on the peripheral surface 25 of the bottom 24. In order to prevent a sliding in the longitudinal direction during the acceleration effect in the longitudinal axial direction of the flying projectile 10 by the segments 13, 13', there is provided an annular groove 26 in the peripheral surface 25 of the bottoms 24 in which a collar 27, arranged on the segments 13, 13', engages. In order to achieve a particularly good locking, and on the other hand however achieve an easy detaching of the segments 13, 13' from the remainder of the flying projectile 10, the groove 26 and collar 27 are preferably wedge-shaped in cross-section (see FIG. 6). There is imparted to the flying vehicle or projectile 10, from the start, a rotational movement, which can also be maintained, respectively reinforced during flight respectively by means of an auxiliary arranged driving means. This rotational movement leads to force components acting transversely to the longitudinal axis, which, with the object of forming a torsion force, act on the segments 13, 13' forming the housing 12. In order to avoid a sliding of the segments 13, 13' in the peripheral direction, the segments 13, 13' and the bottoms 24 in the region of their wedge-shaped joint are either hooked into each other (see FIG. 7) or interengaged by means of teeth 28 (FIG. 8).

Figure 7:
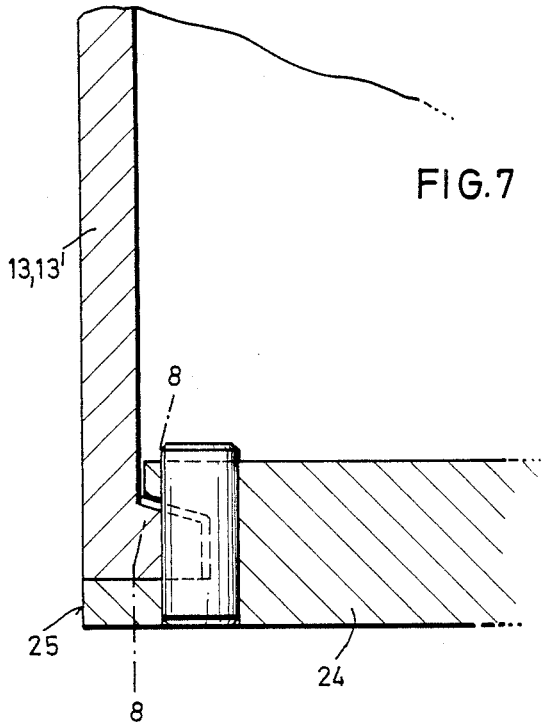
FIG. 7 is a cross-sectional view of a further embodiment for mounting the segments to the bottom of the flying projectile.
Figure 8:
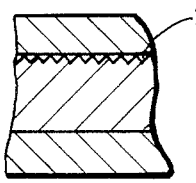
FIG. 8 is a cross-sectional view along line 8—8 of FIG. 7.

FIG. 8 illustrates a cross-sectional view along line 8—8 in FIG. 7.

The segments 13, 13' are preferably made out of the usual light metals which are used in airplane construction or can also be made out of synthetic material, in particular fiber-reinforced synthetic material.

In the interior of the flight projectile 10 there is preferably provided a bracing supporting structure which extends in the longitudinal axial direction of the flight projectile 10, which braced structure divides the useful load chamber 4 into individual compartments 4'; each one of the compartments 4' is adapted to receive a useful load 11 and, on the other hand, provides support points or support surfaces 29 on which the segments 13, 13' with their interior surfaces 40 can additional be supported. Advantageously the support structure includes separating walls 30, which are arranged parallel to the longitudinal axis of the flight projectile, and which encompass an angle between themselves on the bisector of the angle and the rods 18, the hook-shaped extension 15, 15' as well as the junction points between the segments 13, 13' relative to the useful loads 11 are disposed.

In a further not illustrated in detail embodiment of the invention the segments 13, 13' serve simultaneously for mounting auxiliary or correcting drive means, which for example during the flight phase of the flight projectile 10, maintain the spin imparted at the start of the flight or reinforce the spin. The auxiliary or correcting drive means are then at detachment separated from the flying body jointly with the segments 13, 13'.

The unlocking of the segments 13, 13' can in case of need be effected simultaneously or time-wise delayed, the time sequence being controllable by the activation of the pyrotechnic charges 20.

The expulsion of the useful loads 11 can be carried out either simultaneously with the separation of the segments 13, 13' or can be time-wise delayed. The latter possibility permits the planned expulsion of a useful load in correlation to the rotational movement of the flying projectile 10 relative to its longitudinal axis. This has proven to be particularly advantageous in those cases in which a large radial propulsion width at the expulsion of the useful loads 11 is desired.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. An improved cluster bomb projectile for transporting a plurality of useful loads having a cylindrically shaped housing, said loads being adapted to be expelled from said housing at a predetermined point of the flight path of the projectile, the improvement comprising in combination:

said cylindrically shaped housing being formed by a plurality of detachable segments which jointly form a cylindrical housing surface;

each two adjoining segments have a pair of adjoining longitudinally extending side edges and each segment has an inner suface, a plurality of hook-shaped members projecting from the inner surface of each segment at an adjoining side edge interiorly of the housing and past the longitudinally extending side edge of the next adjoining segment, said longitudinally extending side edges of adjoining segments abutting against each other, each pair of hook-shaped members of adjoining segments being disposed one immediately above the other and defining an opening therebetween, said openings defined by pairs of hook-shaped members along confronting side edges of adjoining segments being axially aligned with respect to each other;

a rod is provided for connecting each pair of adjoining segments, which rod extends through all of said aligned openings defined by pairs of hook-shaped members along confronting side edges parallel to the longitudinal axis of the cluster bomb projectile;

said rod being essentially cylindrical in shape and including at least one projection in the region of each pair of hook-shaped members, which projection biasingly abuts against at least one hook-shaped member such that when said rod is moved in a predetermined manner relative to said adjoining segments the pair of adjoining segments are prestressed; and each rod is axially slidably mounted in said aligned openings of said pairs of hook-shaped members.

2. The improved cluster bomb projectile as set forth in claim 1, wherein each rod is also rotatably mounted about its longitudinal axis in said aligned openings of said pairs of hook-shaped members.

3. The improved cluster bomb projectile as set forth in claim 2, wherein each one of said rods is a hollow cylinder which is closed at one end and open at the other end, a pyrotechnic charge and ignition means are operatively mounted adjacent to said open end of said rod.

4. The improved cluster bomb projectile as set forth in claim 3, including guide means on said housing for guidingly supporting opposite ends of each rod.

5. The improved cluster bomb projectile as set forth in claim 3, including a plurality of transverse bottoms mounted in said housing normal to the longitudinal axis of the projectile for subdividing the projectile into a plurality of compartments, said inner surface of each segment abutting against each bottom at the peripheral surface thereof, each peripheral bottom surface having an annular groove and a mating annular radially inwardly extending projection integral with each segment extending into said annular groove.

6. The improved cluster bomb projectile as set forth in claim 5, wherein said annular groove and said annular projection are wedge-shaped in cross-section.

7. The improved cluster bomb projectile as set forth in claim 6, wherein the confronting surfaces of said annular groove and said annular projection are provided with teeth which respectively engage each other.

8. The improved cluster bomb projectile as set forth in claim 7, wherein said segments are made of a material selected from the group of materials consisting of metal, synthetic material and fiber-reinforced synthetic material.

9. The improved cluster bomb projectile as set forth in claim 8, including a bracing structure having a plurality of walls is operatively mounted in said housing which abuts at its radially outer extent against said inner surface of said segments.

10. The improved cluster bomb projectile as set forth in claim 4, wherein each one of said rods is disposed within a compartment defined by at least a pair of walls of said bracing structure.

* * * * *